US011292564B2

(12) United States Patent
Paumier et al.

(10) Patent No.: US 11,292,564 B2
(45) Date of Patent: Apr. 5, 2022

(54) MAST FOR A MARINE OR SUBMARINE VESSEL

(71) Applicant: NAVAL GROUP, Paris (FR)

(72) Inventors: Philippe Paumier, Ruelle sur Touvre (FR); Arnaud Trouve, Ruelle sur Touvre (FR)

(73) Assignee: NAVAL GROUP, Paris (FR)

( * ) Notice: Subject to any disclaimer, the term of this patent is extended or adjusted under 35 U.S.C. 154(b) by 0 days.

(21) Appl. No.: 16/766,318

(22) PCT Filed: Nov. 26, 2018

(86) PCT No.: PCT/EP2018/082609
§ 371 (c)(1),
(2) Date: May 22, 2020

(87) PCT Pub. No.: WO2019/102015
PCT Pub. Date: May 31, 2019

(65) Prior Publication Data

US 2020/0354032 A1 Nov. 12, 2020

(30) Foreign Application Priority Data

Nov. 27, 2017 (FR) ..... 17 01243

(51) Int. Cl.
*B63G 8/04* (2006.01)
*B63B 15/00* (2006.01)

(52) U.S. Cl.
CPC ..... *B63G 8/04* (2013.01); *B63B 15/0083* (2013.01)

(58) Field of Classification Search
CPC ..... B63G 8/04; B63B 15/0083
See application file for complete search history.

(56) References Cited

U.S. PATENT DOCUMENTS 3,207,034 A * 9/1965 Harter ..... G02B 6/06 359/401
4,640,216 A * 2/1987 Lehmann ..... B63G 8/38 114/340
5,290,996 A * 3/1994 Giamati ..... B64C 1/1453 219/201
6,411,260 B1 * 6/2002 Weglarz ..... H01Q 1/34 343/722

FOREIGN PATENT DOCUMENTS

EP 0269893 A1 * 6/1988 ..... H01Q 1/34
EP 0269893 A1 6/1988
FR 2288671 A1 5/1976
GB 1507076 A 4/1978

OTHER PUBLICATIONS

International Search Report, dated Jan. 16, 2019, from corresponding PCT application No. PCT/EP2018/082609.

* cited by examiner

*Primary Examiner* — S. Joseph Morano
*Assistant Examiner* — Jovon E Hayes
(74) *Attorney, Agent, or Firm* — Nixon & Vanderhye

(57) ABSTRACT

Disclosed is a mast intended to equip a marine or submarine vessel. The mast includes a metal structure extending along an axis and a fairing arranged externally to the structure in a direction normal to the axis. The fairing is removably assembled to the structure.

7 Claims, 3 Drawing Sheets

MAST FOR A MARINE OR SUBMARINE VESSEL

BACKGROUND OF THE INVENTION

Field of the Invention

The present invention relates to a mast of the type intended to equip a marine or submarine vessel, the mast comprising a metal structure extending along an axis and a fairing arranged externally to the structure in a direction normal to the axis. The invention also relates to a marine or submarine vessel including such a mast.

Description of the Related Art

Marine or submarine vessels usually have superstructures arranged in the form of masts, in particular used to carry measuring and communication instruments, such as sensors or antennas.

In the case of submarine vessels, these masts also generally comprise a periscope used to perceive the surroundings during diving, as well as a fresh air tube intended to allow the running of the engines of the vessel requiring a supply of oxygen for combustion.

It is known to arrange a fairing around the metal structure of such a mast in order to improve the aerodynamic and/or hydrodynamic properties of the mast, as well as to protect the metal structure. The fairing is usually made up of a composite skin, arranged around the metal structure of the mast, for example made from a matrix of resin and glass fibers.

However, such a fairing has many drawbacks.

First of all, such a fairing does not withstand impacts well, which may be frequent, in particular in the case of submarine vessels, for which the mast is submerged and may encounter drifting objects. The damage inflicted on the fairing may then require the complete replacement thereof.

Next, such a fairing does not make it possible to access the metal structure of the mast, and must be destroyed and replaced when such access is necessary, during maintenance operations, for example.

Lastly, such a fairing is inexpensive, and the assembly procedure thereof is relatively complex.

SUMMARY OF THE INVENTION

One aim of the invention is therefore to provide a mast fairing allowing easier access to the structure of the mast, and the installation and upkeep of which are simplified.

To that end, the invention relates to a mast of the aforementioned type, characterized in that the fairing is removably assembled to the structure.

According to specific embodiments of the invention, this mast includes one or more of the following features, considered alone or according to any technically possible combination(s):

- the fairing is assembled by resilient fitting on a frame of the structure;
- the fairing defines a housing for receiving the frame, the fairing comprising a deformable part defining an access opening to the housing, the opening having a transverse width smaller than a transverse width of the frame;
- the structure includes a plurality of supports protruding from a post, the fairing defining a notch receiving the supports, the supports keeping the fairing against the structure;

- each support defines at least one attachment orifice, the fairing defining at least one opening suitable for emerging on the attachment orifice when the fairing is assembled to the structure, the attachment orifice and the openings being able to receive an attachment member of the fairing to the structure;
- the fairing is made from an elastomer material;
- the fairing is made from a rigid material, in particular a syntactic foam comprising a matrix of resin and glass microbeads included in the matrix;
- the fairing is made up of a plurality of segments assembled on the structure and aligned in a direction parallel to the axis; and
- a contact surface of the fairing on the structure includes a reversible adhesive attaching the fairing to the structure.

The invention also relates to a marine submarine or submarine vessel including at least one mast as described above.

BRIEF DESCRIPTION OF THE DRAWINGS

The invention will be better understood upon reading the following description, provided solely as example and in reference to the accompanying drawings, in which.

DESCRIPTION OF THE PREFERRED EMBODIMENTS

Figure 1:
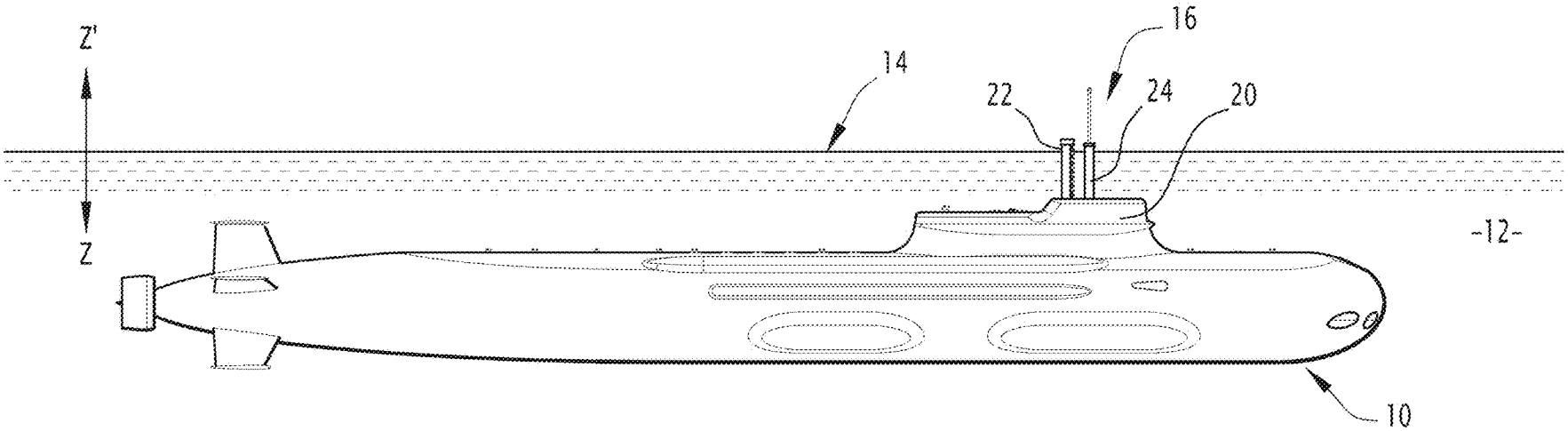
FIG. 1 is a side view of a submarine vessel according to the invention.

In FIG. 1, a submarine vessel 10 is shown submerged in a body of water 12, at a shallow depth below a surface 14 of the body of water 12.

The submarine vessel 10 includes two masts 16, extending from an upper turret 20, the masts 16 protruding from the surface 14.

The masts 16 extend along a substantially vertical axis Z-Z', the axis Z-Z' being substantially normal to the surface 14.

Figure 2:
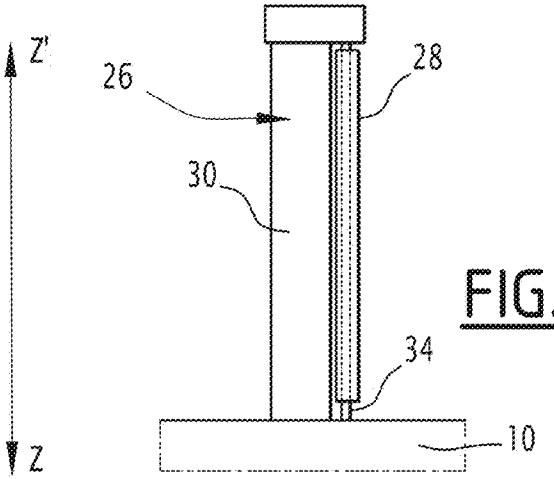
FIG. 2 is a side view of a mast according to a first embodiment of the invention.
Figure 3:
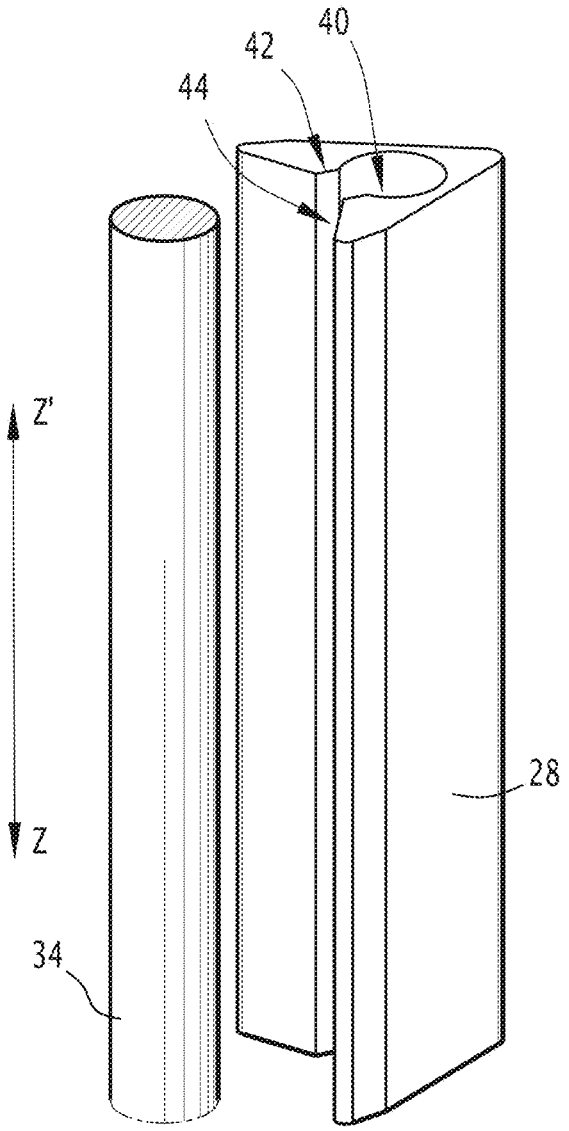
FIG. 3 is in exploded detail view of the mast of FIG. 2.
Figure 4:
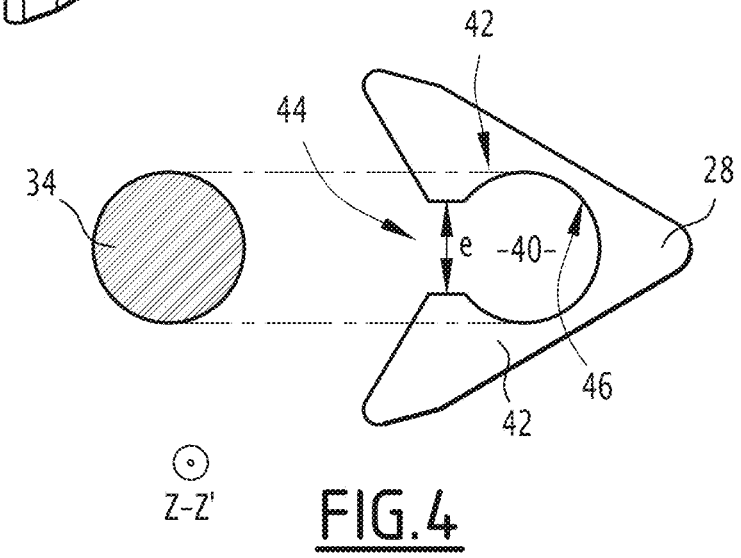
FIG. 4 is a horizontal sectional view of the mast of FIGS. 2 and 3.
Figure 5:
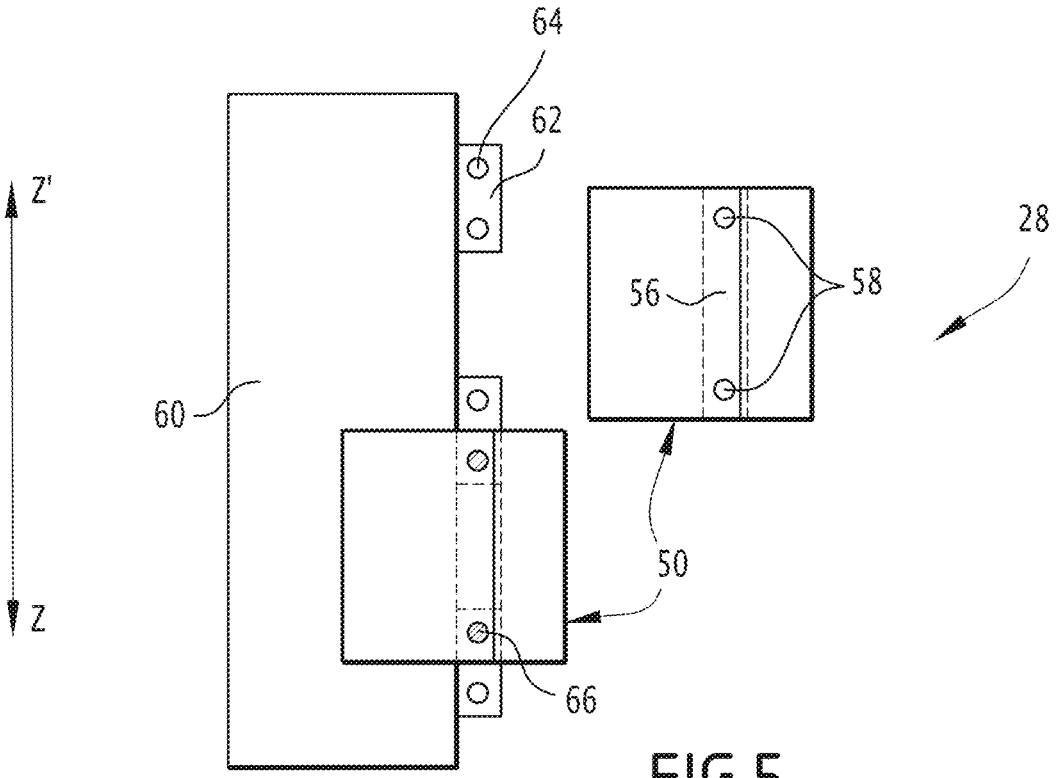
FIG. 5 is a partially exploded side view of a mast according to a second embodiment of the invention.
Figure 6:
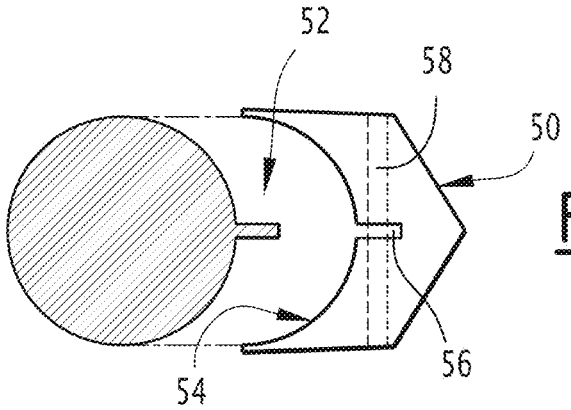
FIG. 6 is a horizontal sectional view of the mast of FIG. 5.

The masts 16 comprise a fresh air tube 22, corresponding to a first embodiment shown in detail in FIGS. 2 to 4, and a standard mast 24, corresponding to a second embodiment shown in detail in FIGS. 5 and 6.

The fresh air tube 22, also called snorkel, includes a raisable metal structure 26 extending along the substantially vertical axis Z-Z', and a fairing 28 arranged externally relative to the structure 26 along a direction normal to the axis Z-Z'.

As shown in FIG. 2, the structure 26 comprises a tube 30 defining an inner pipe emerging at an upper end of the tube 30, and suitable for conveying air from the outside to the inside of the vessel 10 in order to supply engines of the vessel 10.

The structure 26 also comprises a frame 34 extending along a direction substantially parallel to the axis Z-Z', in front of the tube 30 in the direction of movement of the submarine vessel 10.

The frame 34 is for example a bar having a substantially cylindrical elongated shape, secured to the tube 30 at both of its ends.

The fairing 28 is removably assembled to the structure 26, and received by the frame 34. "Removable" means that the fairing 28 can be removed from the structure 26 in particular without damaging the fairing 28 or the structure 26, such that the same fairing 28 can next be reassembled on the structure 26 without requiring repairs or replacements.

In the first embodiment, the fairing 28 is assembled by resilient fitting on the frame 34.

The fairing 28 is shown in detail in FIGS. 3 and 4. The fairing 28 has a prismatic shape elongated in a direction parallel to the axis Z-Z', with a substantially triangular arrowhead-shaped section, so as to have a hydrodynamic profile.

The fairing 28 defines a substantially cylindrical housing 40 suitable for receiving the frame 34, the housing having an inner diameter equal to or slightly smaller than a diameter of the frame 34.

The fairing 28 comprises a deformable part 42 defining an opening 44 for access to the housing 40.

In the example shown in FIGS. 2 to 4, the fairing 28 is made in a single piece from a resilient material, for example an elastomer. The entire fairing 28 then constitutes the deformable part 42.

The elastomer is for example a polyolefin of high molecular weight or a natural or artificial rubber. The elastomer advantageously has a hardness of between 50 Shore A and 80 Shore A, advantageously close to 70 Shore A.

In a variant, the fairing 28 comprises several parts made from different materials, at least one of which makes up the deformable part 42.

As shown in FIG. 4, the opening 44 has a transverse width e smaller than the diameter of the frame 34. The deformable part 42 is therefore resiliently gripped around the frame 34 and keeps the fairing 28 on the structure 26.

The opening 44 is able to deform so as to increase its transverse width e reversibly and to allow the passage of the frame 34 during the assembly and disassembly of the fairing 28.

Advantageously, a contact surface 46 of the fairing 28 on the frame 34 includes an adhesive improving the attachment of the fairing 28.

The contact surface 46 extends around the housing 40, in a cylinder portion.

The adhesive is a reversible adhesive, that is to say, an adhesive having a moderate resistance to shearing stresses applied in a direction substantially tangential to the contact surface 46, and a low resistance to the peeling stresses applied in a direction substantially normal to the contact surface 46. The attachment offered by the adhesive is of the type known as "temporary bonding", "repositionable bonding" or "nonpermanent bonding".

In particular, the reversible adhesive has a shearing strength of less than 5 MPa, advantageously less than 1.5 MPa, and a peeling strength of less than 2 MPa, advantageously less than 0.5 MPa.

The low peeling strength of the adhesive allows the assembly of the fairing 28 on the structure 26 to stay removable, while offering a low resistance to removal by peeling of the fairing 28 from the frame 34.

The adhesive prevents the rotational movements of the fairing around the frame 34, which are associated with shearing stresses for which the adhesive has a strength greater than that relative to the peeling stresses.

The fairing 28 according to the first embodiment is more resistant to impacts with drifting objects due to the fact that it is made from an elastomeric material, and effectively absorbs the vibrations due to drag.

In the second embodiment, shown in detail in FIGS. 5 and 6, the standard mast 24 comprises a structure and a fairing comprising a plurality of separate segments 50 assembled on the structure and aligned in a direction parallel to the axis Z-Z'.

Two segments 50 are shown in FIG. 5, one assembled on the structure and the other separated from the structure.

Each segment 50 has a prismatic shape elongated in a direction parallel to the axis Z-Z', with an arrowhead-shaped section shown in detail in FIG. 6.

Each segment 50 defines a substantially semi-cylindrical housing 52 delimited by a contact surface 54 extending on a rear part of the segment 50.

The segments 50 are for example made from a rigid material, in particular a syntactic foam comprising a resin matrix in which hollow glass spheres have been injected.

Each segment 50 also defines at least one attachment notch 56 emerging in the housing 52 and extending over the entire height of the segment 50 in the direction parallel to the axis Z-Z'.

The segment 50 further defines two substantially cylindrical through openings 58, extending in a direction orthogonal to the axis Z-Z', emerging in the notch 56 and on opposite sides of the segment 50.

In the second embodiment, the structure comprises a post 60 extending in a direction parallel to the axis Z-Z' and a plurality of supports 62 protruding from the post 60 in a direction orthogonal to the axis Z-Z'.

The supports 62 are suitable for engaging in the notch 56 of each segment 50 during the assembly of the segment 50 on the structure, and thus keeping the segment 50 against the structure. The supports 62 engaged in the notch 56 prevent any rotation of the fairing 28 around the structure.

In the illustrated example, each support 62 defines two attachment orifices 64. The attachment orifices 64 are arranged so that the openings 58 of one of the segments 50 emerge on the attachment orifices 64 of two successive supports 62 when the segment 50 is assembled on the structure.

The fairing 28 then comprises attachment members 66 received in the openings 58 and the orifices 64 so as to attach the segment 50 on the structure. The attachment members 66 are for example buttons.

In a variant that is not shown, the supports 62 have a hook shape and are suitable for cooperating with pins arranged in the notch 54 so as to keep the segment 50 against the structure with no attachment member 66.

The mast 16 according to the second embodiment comprises a fairing 28 assembled removably, since one or several attachment members 66 can be withdrawn in order to remove one or several segments 50, which can next be reassembled as is.

The fairing 28 additionally allows a partial replacement in case of damage, for example in case of impact with a drifting object, by replacing the damaged segments 50 only.

Making the fairing 28 from syntactic foam allows it to have an excellent resistance to hydrostatic pressures, while retaining a sufficiently low density.

The invention claimed is:

1. A mast configured to equip a marine or submarine vessel, the mast comprising:

a metal structure extending along an axis, the structure including a plurality of supports protruding from a post; and a fairing disposed externally to the metal structure in a direction normal to the axis, the fairing being removably assembled to the metal structure, the fairing defining a notch configured to receive the supports, the supports keeping the fairing against the metal structure.

2. The mast according to claim 1, wherein each of the supports defines at least one attachment orifice, the fairing defining at least one opening configured to emerge on the attachment orifice when the fairing is fit to the metal structure, the attachment orifice and the at least one opening being configured to receive an attachment member of the fairing to the structure.

3. The mast according to claim 1, wherein the fairing is made from a rigid material.

4. The mast according to claim 1, wherein the fairing is made up of a plurality of segments assembled on the structure and aligned in a direction parallel to the axis.

5. The mast according to claim 1, wherein a contact surface of the fairing on the structure includes a reversible adhesive attaching the fairing to the structure.

6. A marine or submarine vessel comprising:

at least one of the mast according to claim 1.

7. The mast according to claim 3, wherein the rigid material is a syntactic foam comprising a matrix of resin and glass microbeads included in the matrix.

* * * * *